United States Patent [19]

Rösch et al.

[11] Patent Number: 4,612,867

[45] Date of Patent: Sep. 23, 1986

[54] METHOD AND APPARATUS FOR THE PATTERN-CORRECT SEWING TOGETHER OF CLOTH PARTS

[75] Inventors: Joachim Rösch, Enkenbach-Alsenborn; Heribert Geisselmann, Stutensee; Richard Wagner, Karlsruhe, all of Fed. Rep. of Germany

[73] Assignee: Pfaff Industriemaschinen GmbH, Fed. Rep. of Germany

[21] Appl. No.: 683,405

[22] Filed: Dec. 19, 1984

[30] Foreign Application Priority Data

Dec. 21, 1983 [DE] Fed. Rep. of Germany ..... 3346163

[51] Int. Cl.[4] ..... D05B 27/06; D05B 27/08

[52] U.S. Cl. ..... 112/314; 112/262.1; 112/121.11

[58] Field of Search ..... 112/314, 313, 312, 315, 112/316, 262.1, 121.11, 121.26, 266.1

[56] References Cited

U.S. PATENT DOCUMENTS

| | | | |
|---|---|---|---|
| 3,954,071 | 5/1976 | Mall et al. | 112/314 X |
| 3,980,032 | 9/1976 | Kleinschmidt et al. | 112/313 |
| 4,419,949 | 12/1983 | Goodman et al. | 112/262.1 |
| 4,526,116 | 7/1985 | Mannel | 112/121.12 X |

*Primary Examiner*—Peter Nerbun

*Attorney, Agent, or Firm*—McGlew and Tuttle

[57] ABSTRACT

A method and apparatus for the pattern-correct sewing together of two pieces of cloth having the same pattern by a sewing machine with one cloth feed mechanism arranged over and one arranged under the cloth pieces, the feed quantity of which is variably by at least one positioning system relative to each other, uses a sensor arranged upstream of a stitch forming point for each cloth piece and a signal processing unit which processes signals from the sensors corresponding to the relative position of the cloth pieces and which influences the positioning system for the feed mechanism in accordance with the established relative position of the cloth pieces. For the pattern-correct sewing together of the two cloth pieces, the pattern structure of each cloth piece is continuously determined by the sensors by measuring values of a structure-or pattern-typical criterion. The found values are sent as signals to the signal processing unit, and the signals of both sensors, taken from the two cloth pieces within the same predetermined length before the stitch forming point, are stored independently of each other in the signal processing unit as signal sequences. From the signal sequences the signal processing unit determines the momentary offset between the two cloth parts by calculation of their degree of overlap and thereby controls the positioning system.

15 Claims, 8 Drawing Figures

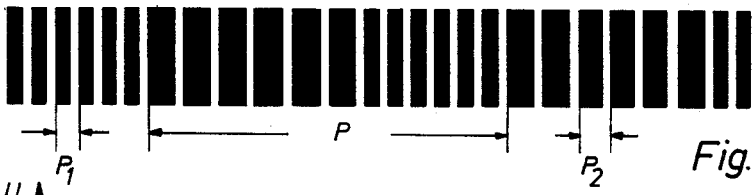
Fig. 1
Fig. 6
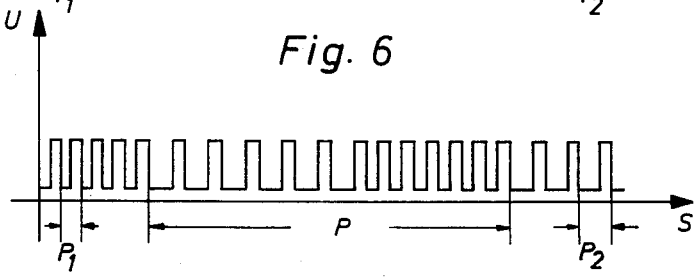
Fig. 7
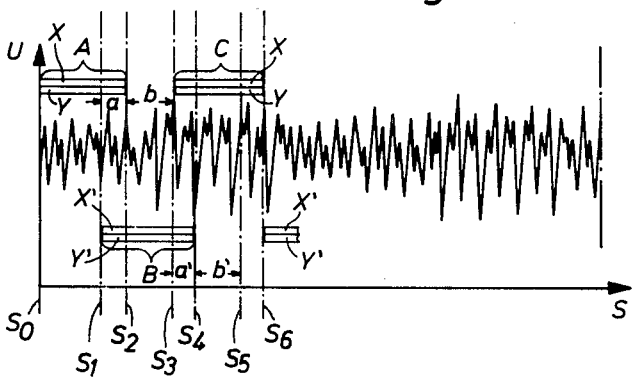
Fig. 8
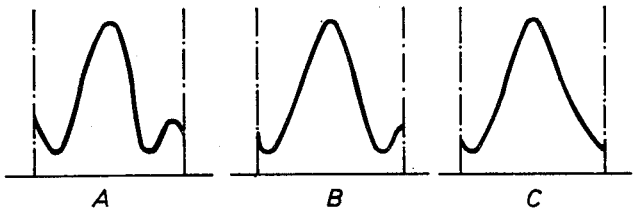

METHOD AND APPARATUS FOR THE PATTERN-CORRECT SEWING TOGETHER OF CLOTH PARTS

FIELD AND BACKGROUND OF THE INVENTION

The present invention relates in general to sewing machines, and in particular to a new and useful method and apparatus for sewing together two pieces of cloth while maintaining correct alignment of a pattern on the two pieces of cloth.

A method for the pattern-correct sewing together of two cloth parts or pieces having the same pattern structure is not yet known. A sewing machine is known (German OS 24 12 896) which can sew together two cloth parts in equal lengths. Here the length difference of the two ends of the cloth parts is measured by sensors, and via an evaluating system the positioning system for the feed means is influenced accordingly. Through German Pat. No. 24 37 377 a similar device is known, in which the feed correction is checked by a second sensor arrangement during sewing and the evaluating system carries out a correction of the feed related deviation.

In the arrangements according to the state of the art, therefore, only the offset of the ends of the cloth parts can be compensated during the sewing operation, in that the value of this offset is supplied to the evaluating system, which then, after calculation of the necessary correction, controls the displacement of the positioning system for the feed of the cloth parts. A pattern-correct sewing together of cloth parts is therefore not possible with the known arrangements. Instead, pattern-correct sewing was heretofore possible only by continuous visual control of the seamstress and correction when necessary. This work, however, requires great concentration and care and is possible only at very low sewing speeds with interruptions of the sewing operation.

SUMMARY OF THE INVENTION

It is the object of the present invention to provide a method and a system for the pattern-or-structure-correct sewing together of several cloth parts or pieces.

Accordingly an object of the present invention is to provide a method and apparatus for the pattern-correct sewing together of two pieces of cloth which each carry the same pattern structure, by a sewing machine with one cloth feed means arranged over and one cloth feed means arranged under the cloth pieces, a relative feed amount of the feed means being variable by at least one positioning system or relative cloth feed adjustment means which is capable of changing the relative position of the cloth pieces. The invention utilizes a sensor arranged upstream of a stitch forming point where the cloth pieces are to be sewn together, for generating signals that correspond to a position of each cloth, the signals being formed by the sensing of the pattern on each cloth piece. A signal processing unit is connected to each sensor for processing the signals and for generating a correction signal which is applied to the positioning system for adjusting the relative positions of the cloth pieces so that the patterns become aligned. Thereby the mutual difference of the pattern structure of the two cloth parts is determined continuously and is automatically compensated by correction of the positioning system for the cloth feed.

A further object of the invention is to provide a method wherein the single processing unit comprises an arithmetic unit which determines an offset between the two cloth pieces from a sequence of signals coming from the sensors, and operates to calculate a cross correlation function and a displacement from a normal aligned position of the cloth pieces and their patterns. The patterns may be sensed by illuminating the cloth pieces near an area where their position is to be measured and sensing the reflected light.

By evaluating the signal sequences, an unambiguous determination of the relative position of the two cloth parts can be achieved.

This can be accomplished by combining the signals from a short length of the fabric containing a fine structure of the pattern, and a larger length which contains a repeat pattern that is made up of the fine structure pattern.

A further object of the invention is to provide an apparatus for the pattern-correct sewing together of two cloth pieces which each carry the same pattern, comprising stitch forming means for forming a stitch at a stitch forming area, first cloth feed means for feeding one of the cloths in a feed path, second cloth feed means for feeding the other cloth in the feed path, relative cloth feed adjustment means connected to adjust the relative positions of the cloth pieces moving along the feed path, first and second sensor means each adjacent the stitch forming area and provided to sense the passing pattern of each respective cloth piece and to generate signals corresponding to the position of each cloth piece, and a signal processing unit connected to the sensors for receiving a sequence of signals and which can generate a signal corresponding to an offset between the positions of the two cloths, the offset signal being utilized to operate the relative cloth feed adjustment means to realign the patterns of the two pieces of cloth.

A further object of the invention is to provide such a device wherein the sensors each comprise a light receiving element which can optically sense the pattern of each cloth piece, the light-receiving element preferably comprising a row of light sensing members lying transversely to a feed direction of the cloth pieces on the feed path.

In particular, by using a short length of light-receiving elements in the feed direction and by measuring the integral over a sufficiently large area crosswise to the feed direction, a high resolution of pattern definition is obtained while the susceptibility of the method and system to error is low.

An alternative signal processing mechanism is feasible in an arrangement of the signal receiving elements wherein a matrix field of light sensors is provided in rows and columns. Such an arrangement permits a pattern position determination of the two cloth parts independent of the transport speed. To avoid blur due to motion, the non-transport phase of the intermittent cloth transport of the sewing machine can be utilized for signal reception.

A further object of the invention is to provide a sewing machine for the pattern-correct sewing together of cloth pieces having the same pattern, which is simple in design, rugged in construction and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which a preferred embodiment is illustrated.

BRIEF DESCRIPTION OF THE DRAWINGS

In the Drawings:

FIG. 1 is a schematic representation of a periodically striped pattern structure for a piece of cloth, on an enlarged scale;

FIG. 6 is a signal pattern at the output of a sensor during scanning of the pattern structure shown in FIG. 1;

FIG. 7 is a signal pattern at the output of a transducer during scanning of a cloth piece having a certain pattern structure; and FIG. 8 shows the correlator functions, calculated by the signal processing unit, of different regions of the signal pattern according to FIG. 7.

DESCRIPTION OF THE PREFERRED EMBODIMENT

Figure 2:
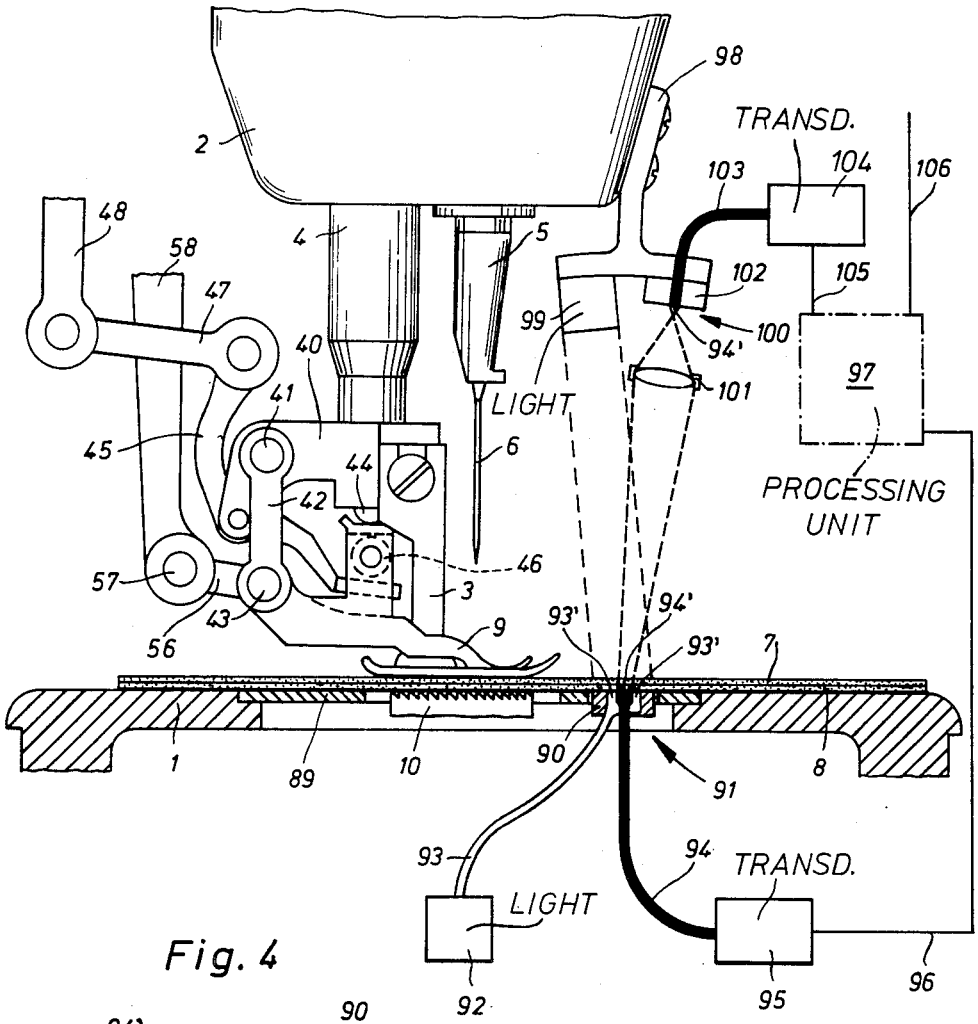
FIG. 2 is a side view of the sewing machine with the inventive control arrangement.

Referring to the drawings in particular, the invention illustrated therein comprises a sewing machine which is capable of stitching two or more cloth pieces together while maintaining correct alignment of a pattern carried by each of the pieces.

When outer garment parts are sewn together, frequently materials are used which have, in two directions which are perpendicular to each other, a periodically striped structure or pattern. For the pattern-correct sewing together of these cloth pieces or parts, usually only the structure in one of these two directions needs to be taken into consideration. Often the pattern or structure consists of a long period base structure, the so-called repeat, which is filled out by one or more short period fine structures extending over a limited part of the repeat. FIG. 1 schematically represents a detail from such a stripe structure in one direction. Here P denotes the repeat while $P_1$ and $P_2$ designate two different fine structure forms. For pattern-correct sewing, the two cloth parts to be sewn must match both with respect to the base structures P and with respect to the fine structures $P_1$ and $P_2$.

FIG. 2 shows the side view of a part of a sewing machine which comprises in known manner a bottom plate 1 and a head 2. Received in the head 2 of the sewing machine is a presser bar 4 carrying a conventional presser foot 3, and also a needle bar 5, whose thread carrying needle 6 cooperates with a looper or a shuttle (not shown). For pushing forward two cloth parts 7 and 8 to be joined together, the sewing machine has an upper feeder 9 and a lower feeder 10.

Figure 3:
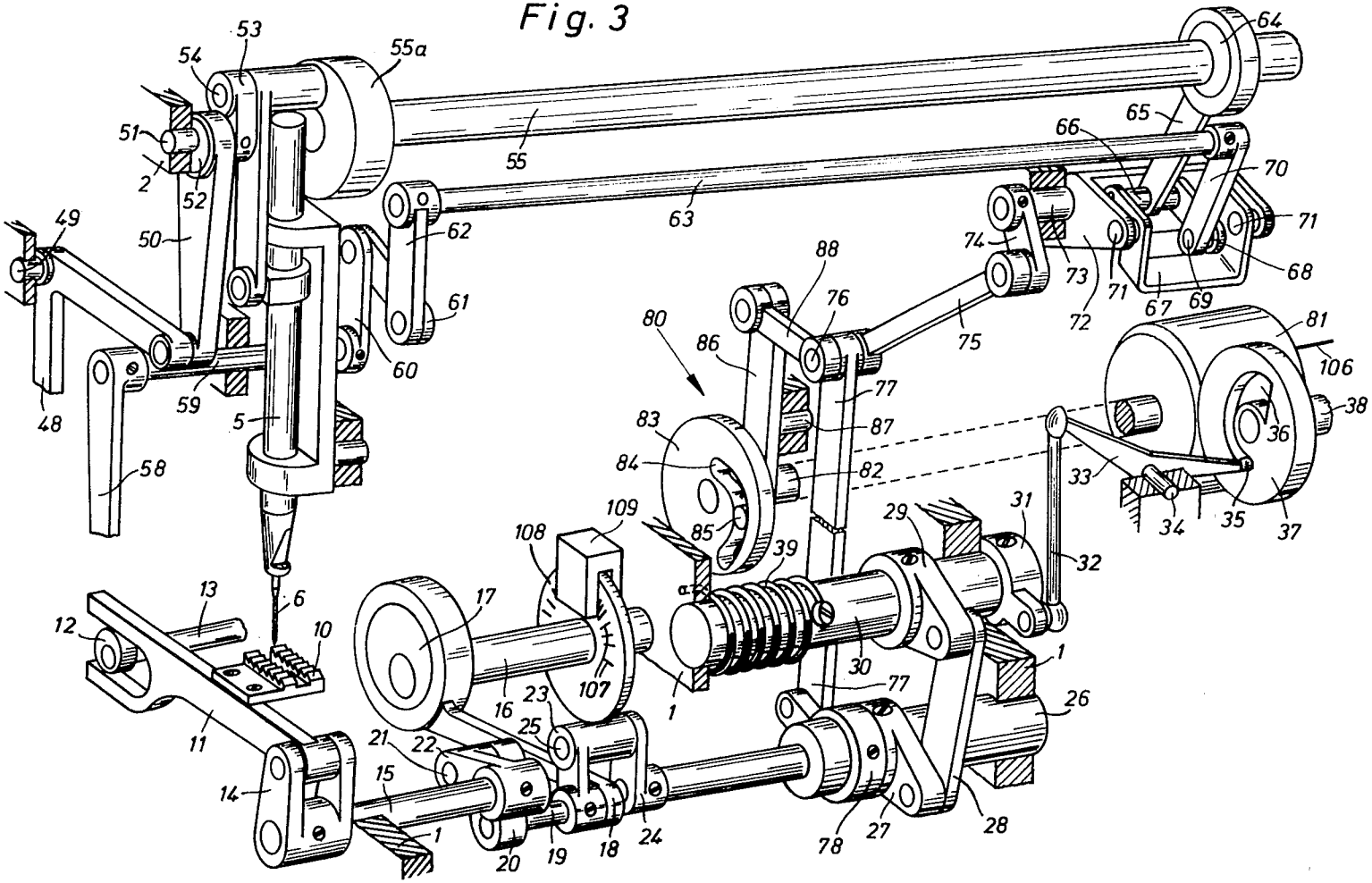
FIG. 3 is a front perspective view of the sewing machine of the invention.

The lower feeder 10 (FIG. 3) is carried by a holder 11 which is arranged below the bottom plate 1 and whose forked end embraces an eccentric 12 which is arranged on a shaft 13 mounted in the bottom plate 1. Eccentric 12 imparts to the feeder 10 a stroke movement with every stitch-forming process. The as yet free end of holder 11 is connected to a forked link 14 which is fastened on a shaft 15 likewise mounted in the bottom plate 1. For the drive of shaft 15, a shaft 16 which is parallel to shaft 15 and which is driving in connection with it, has an eccentric 17 fastened to it. An eccentric rod 18 of eccentric 17 is articulated on a journal 19. Mounted on journal 19 is a link 20, which by means of a journal 21 is connected to a crank 22 fastened on shaft 15. Laterally of the eccentric rod 18, on journal 19, a link 23 is fastened, which embraces a journal 25 carried by a crank 24. As can be seen in FIG. 3, the effective length of link 23 equals the effective length of link 20, so that when the two journals 21 and 25 are in alignment, shaft 15 remains at rest even though eccentric rod 18 moves.

To vary the ability of eccentric rod 18 to move shaft 15, crank 24 is clamped onto a setting shaft 26 which is mounted in the bottom plate 1 and which carries in addition a setting crank 27. Through an intermediate member 28 and an additional setting crank 29, the setting crank 27 is connected to an intermediate shaft 30 which is mounted on the bottom plate 1. A lever 31 is clamped to the free end of shaft 30. The lever 31 is connected by a ball-end pull rod 32 to one end of a rocking lever 33, which swivels about an axle 34 which is fixed to the sewing machine housing. The as yet free end of rocking lever 33 has a spherical projection 35 and protrudes into a positioning cam or cam slot 36 of a fixable adjusting wheel 37 disposed on an axle 38 which is held by the housing. The positioning cam 36 in the adjusting wheel 37 spirals relative to the wheel's axle 38 in such a way that stitch lengths of e.g. 1 to 6 mm can be adjusted for the lower feeder. A spring 39, surrounding the intermediate shaft 30 and fastened on the bottom plate 1 on one side, holds the projection 35 of rocking lever 33 in permanent abutment on one of the side walls of the adjusting cam 36.

At its lower end, the presser bar 4 (FIG. 2) is provided with a cross-piece 40 carrying a pin 41. On pin 41 is mounted a link 42 which by means of a journal 43 is articulatedly connected to the upper feeder 9. The feeder 9 is urged downwardly by a spring loaded ball 44 and receives its stroke movement from a lever 45 which is pivotably mounted on support 40 and whose free end engages a roller 46 from below. Roller 46 is carried by two lateral bearing webs of the upper feeder 9. The other end of lever 45 is connected through an intermediate member 47, to an angle lever 48 which is pivotably mounted on a journal 49 (FIG. 3) fixed to the housing. The angle lever 48 is articulated to an eccentric rod 50 which embraces an eccentric 52 rotatably mounted on a journal 51 in head 2. Eccentric 52 receives its drive from an intermediate member 53 which is rotatably mounted on a journal 54 which in turn is carried by the arm shaft crank **55*a* formed in one piece with the upper main shaft 55 of the machine. As a comparatively slight swinging motion of the angle lever 48 suffices to raise the upper feeder 9, the point of articulation of intermediate member 53 and eccentric 52 lies on a prolongation of the crank 55*a* of the upper main shaft 55** of the sewing machine.

To drive the upper feeder 9 (FIG. 2), an intermediate link 56 engages feeder 9 at journal 43. Link 56, by means of a journal 57 is connected to a rocking lever 58, which in turn is fastened on a rocking shaft 59 mounted in head 2 of the sewing machine (FIG. 3). The rocking shaft 59 derives its drive from a crank 60 fastened on it, which is connected through a link 61 to a crank arm 62 of an upper rocking shaft 63. The upper rocking shaft 63 is driven indirectly by an eccentric 64 arranged on the upper main shaft 55, its eccentric rod 65 embracing a journal 66 which is carried by two lateral webs of a yoke 67. At journal 66 there engages also a link 68, which is articulated by means of journal 69 to a crank 70 carried by the upper rocking shaft 63. By means of two mutually aligned bearing pins 71 and 71, yoke 67 is pivotably mounted on a positioning member 72 which is provided with an axle stub 73 and is pivotably mounted in the housing of the sewing machine. When the positioning member 72 is pivoted about its axle stub 73, the relative position between the bearing pins 71 and journal 69 changes and hence also the magnitude of the swinging motion of crank 70 changes.

To displace the positioning member 72, its axle stub 73 has fastened on it a link 74 which through a link 75 and a journal 76 engages at the upper end of a connecting rod 77. The lower end of the connecting rod is articulated to a positioning crank 78 which in turn is clamped onto the positioning shaft 26. By this arrangement a displacement of the adjusting wheel 37 for feed adjustment of the lower feeder 10 can be changed synchronously with the feed adjustment of the upper feeder 9.

To be able to vary the amount of feed of the upper feeder 9 to obtain equal feed lengths of the two cloth parts 7 and 8 relative to the amount of feed of the lower feeder 10, an adjusting system or relative adjustment means 80 is provided which comprises a step motor 81 as well as a control disc 83 arranged on a drive shaft 82 of the motor. A curved groove 84 is cut in disc 83, into which a pin 85 engages. The pin 85 is received by a rocking lever 86 which swivels about an axle 87 fixed to the housing and is articulatedly connected at its upper end to an intermediate member 88. The as yet free end of intermediate member 88 engages at journal 76 connecting the connecting rod 77 to link 75, and thus makes it possible, with the adjusting wheel 37 engaged, to vary the angular position of the two links 74 and 75 forming a bending joint, to vary the amount of feed of the upper feeder 9.

In the bottom plate 1 (FIG. 2) a stitch plate 89 is received, which has a cutout for passage of the lower feeder 10. Into a second cutout of the stitch plate 89 there protrudes a measuring head 90 of a sensor 91 for the lower cloth part 8. The surface of measuring head 90 ends at the surface of stitch plate 89. A light source 92 is connected, through a light guide 93 consisting of a plurality of optical fibers, to the measuring head 90, to which is connected, via a further light guide 94 also consisting of a plurality of optical fibers, an opto-electronic transducer 95, which includes a measuring point opposite the end points of the optical fibers and which is connected via a line 96 to a signal processing unit 97.

Arranged on a support 98 attached to head 2 is a light source 99 of an additional sensor 100. Light source 99 illuminates the surface of cloth part 7. Attached to the support 98 is a lens 101 as well as a measuring head 102, to which the light reflected by the measuring point is guided via lens 101 and which is connected by a light guide 103 to an opto-electronic transducer 104. The latter is connected via a line 105 to the signal processing unit 97, the output of which is in turn connected by a line 106 to the step motor 81. By insertion of an optical filter in the ray path between the light source and the measuring point, color structures of the cloth parts can be emphasized to increase their contrast.

Shaft 16 (FIG. 3) carries a pulse disc 108 bearing a plurality of line marks 107 and cooperating with a pulse generator 109. The line marks 107 are present on a part of the pulse disc 108 only, namely on that part which traverses the pulse generator 109 during the transport phase of feeder 10. Thus the pulse generator delivers clock pulses only during the transport phase of the sewing machine.

For exact coincidence of the delivered pulses with equal portions of a feed step of the feeders 9 and 10 of the same amount, the line marks 107 advantageously exhibit different angular distances adapted to the irregularly progressing feed movement. The angular distance between two adjacent line marks 107 represents a constant feed portion of a single feed step of the feeders 9 and 10.

Figure 5:
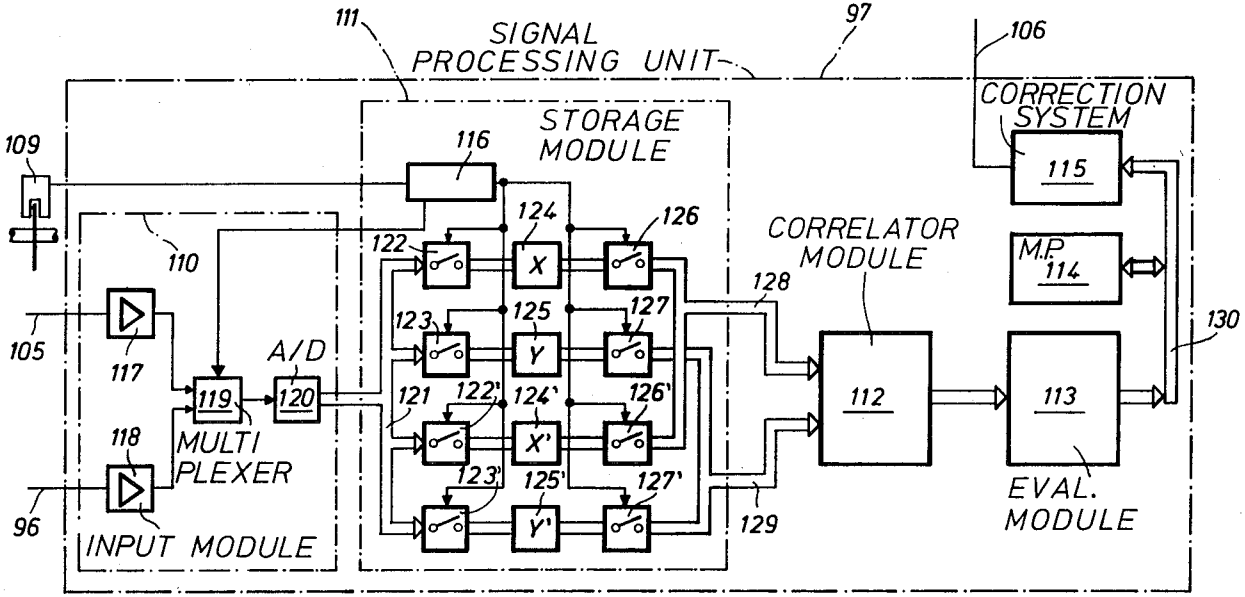
FIG. 5 is a block diagram of the signal processing unit of the invention.

The signal processing unit 97 (FIG. 5) comprises an input module 110, a storage module 111, a correlator module 112, a coordinate evaluating module 113, a microprocessor 114, and a correction system 115, which are connected together by appropriate lines.

Line 105 is connected to an amplifier stage 117, and line 96 to an amplifier stage 118, both being arranged in the input module 110 and connected to inputs of a multiplexer 119. The output thereof is connected to an A/D converter 120, which is connected via a bus line 121 to controllable digital switches 122, 123, 122' and 123' provided in the storage module 111. A memory 124, 125, 124', 125' is connected to each switch 122, 123, 122', 123', which in turn is connected to a digital switch 126, 127, 126', 127'. The outputs of the digital switches 126 and 126' are connected via a common bus line 128, and the outputs of the digital switches 127 and 127' via a common bus line 129, to inputs of the correlator module 112, which in turn is connected to the coordinate evaluating module 113, which contains a memory for the correction function and an evaluating system. Evaluating module 113 is connected to a bus line 130, with which also the microprocessor 114 and the corrections system 115 are connected. Via line 106 finally the correction system 115 is connected to the step motor 81 (FIG. 3).

Figure 4:
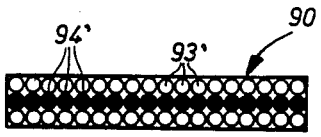
FIG. 4 is a plan view of a measuring head for a sensor of the invention.

The two measuring heads 90 and 102 (FIG. 4) are designed in such a way that their field of vision is small in the direction of movement of the cloth parts 7 and 8, while it is large in the direction normal thereto. Thereby a high resolution of the measuring system in the movement direction is obtained, while at the same time, due to summing of the light intensity crosswise to the feed direction, stochastic and systematic influences of the fabric pattern structure (e.g. caused by longitudinal stripes) are reduced. FIG. 4 shows the field of vision of measuring head 90 facing the cloth part 8, on an enlarged scale. As the figure shows, the field of vision consists of an inner row of end points of the fibers of the light guide 94 serving as light-receiving elements 94', and of two outer rows of end points of the fibers of light guide 93 serving as light emitting elements 93'. The light guides 93 and 94 are distributed over the total surface of the field of vision in such a way that a sufficiently uniform illumination and measuring sensitivity over the total field of vision is obtained. In the case of measuring head 102 for observation of the upper cloth part 7, only the light-receiving elements 94' of light guide 103 are in the field of vision.

Measurement of the mutual correlation of the cloth parts 7 and 8 is carried out by comparison of the signal delivered by opto-electronic tansducers 95 and 104 on the lines 96 and 105. FIG. 6 shows the signal course which would be produced by the cloth structure according to FIG. 1 at uniform movement at one of the transducers 95 or 104. The periods of the spatial base structure P and the fine structure $P_1$ and $P_2$ in FIG. 1 correspond to the base intervals and time periods $P_1$ and $P_2$ of the fine structures. If in FIG. 2 the cloth parts 7 and 8 are not offset relative to each other, uniform signal sequences will result on line 96 and 105, but if the cloth parts 7 and 8 are offset relative to each other, the signals at the transducers 95 and 104 will have a similar form, but will be displaced relative to each other in time. If the speed of the cloth parts 7 and 8 is known, this time shift is a measure of the offset v in space. If $s_1(t)$ is the signal resulting at the output of transducer 104, and $s_2(t)$ the signal resulting at the output of transducer 95, there applies in case of offset:

$$s_2(t)=s_1(t+t_v) \tag{1}$$

In known manner the delay $t_v$ at time $t_o$ is measured by formation of the cross-correlation function $$K_{12}(t_o;\tau) = \frac{1}{T} \int_{t_o - T}^{t_o} s_1(t) \cdot s_2(t - \tau)dt \tag{2}$$

T being the integration interval.

With equation (1) we find that $$K_{12}(t_o;\tau) = \frac{1}{T} \int_{t_o - T}^{t_o} (s_1(t) \cdot s_1(t + t_v - \tau)dt \tag{3}$$

$K_{12}(t_o;\ \tau)$ has its maximum at $\tau=t_v$. By calculation of the cross correlation function (2) and determination of the displacement parameter belonging to its maximum, the delay $t_v$ at measuring time $t_o$ is thereby determined.

When sewing the two cloth parts 7 and 8, which are placed by the seamstress under the presser foot 3 in approximately pattern-correct superposition, the two measuring heads 95 and 102 of the sensors 91 and 100 continuously pick up the brightness values via the light guides 94 and 103, respectively, to the transducers 95 and 104. In them the sum of the brightness values picked up by the light-receiving elements 94' of light guide 94 and of light guide 103, respectively, is measured, and the sum values are delivered as electrical signals separately via the guides 96 and 105 to the signal processing unit 97.

FIG. 7 illustrates the signal sequence of cloth part 8 during sewing, measured for example by transducer 95, a certain fabric pattern being assumed. On the other cloth part 7, having the same fabric pattern, the transducer 104 measures via the measuring head 102 a similar signal sequence, in which, according to the optical dimensions of the receiving system, the amplitude values may be changed and the signal sequence is offset according to the offset of the two cloth parts 7 and 8 relative to that measured at transducer 95. The signal values measured by the transducers 95 and 104 are supplied to the multiplexer 119 via lines 96 and 105 by way of the amplifier stages 117 and 118. With the control unit 116 alternately one of the signals is switched through to the A/D converter 120. As a result of the clock pulses delivered by the pulse generator 109 and proportional to the feed of the cloth parts 7 and 8, two signal sequences with equi-distant scanning values are obtained.

From the A/D converter 120, the digitalized signal values are sent to the bus line 121. Via the digital switches 122, 123, 122', 123', the control unit 116 controls the transmission of the digitalized signal values to the respective memories 124, 125, 124', 125'. As schematically shown in FIG. 7, the storage is overlapping, i.e. the signal values from start of sewing $s_0$ to sewing position $s_1$ are deposited in memory 124 for the upper cloth part 7 and in memory 125 for the lower cloth part 8. From this time on, the signal values in the feed section a are stored parallel, that is, in the memories 124 and 125 as well as in the memories 124' and 125'. From sewing position $s_2$ on, storage of the data in memories 124 and 125 is stopped, while storage in the memories 124' and 125' is continued up to sewing position $s_4$.

Within the time required to cover the distance between sewing position $s_2$ and $s_3$ (feed section b), the control unit 116 controls via the digital switches 126 and 127 the read-out of the memory contents of memories 124 and 125 via the bus lines 128 and 129 to the correlator module 112. There the cross correlation function values from the two data sequences deposited in memories 124 and 125 are calculated from the data sequences of the respective evaluated regions of the two cloth parts 7 and 8. FIG. 8 shows correlation values of different zones A, B and C indicated in FIG. 7.

The correlation function values of the evaluated scanning zones, x,y and x', y', respectively, are then transferred into the coordinate-evaluating module 113, and the correlation maxima as well as their positions are calculated. By evaluation of the position and height of the maxima the offset of the two cloth parts 7 and 8 is calculated. The evaluation is controlled through the microprocessor 114. The latter then also brings about via the correction unit 115 a corresponding influence on on the step motor 81. To this end, a sequence of corrected signals is formed by the correction unit 115, depending on the offset of the two cloths parts 7 and 8. The correction signals are supplied in suitable manner via line 106 to the step motor 81 as step pulses for its displacement.

In the embodiment of the invention shown, if the positions of the patterns of the two cloth parts 7 and 8 differ, only the adjustment of the upper feeder 9 is changed relative to the adjustment of the lower feeder 10, using the device 80, in order thus to obtain coincidence of the patterns. Naturally it would be possible also to change the adjustment of the lower feeder 10 instead of the upper, or to change the adjustment of both feeders 9 and 10 accordingly.

If, despite the synchronous feed movement of the two feeders 9 and 10, one of the two cloth parts 7, 8 leads relative to the other, for instance the upper cloth part 7 relative to the lower cloth part 8, the step motor receives corresponding step pulses and imparts an intermittent rotary movement to shaft 82 and hence to the control disc 83. The rocking lever 86 executes a swinging movement about its axis 87 fixed to the housing and changes, through the intermediate member 88, the relative position of the two links 74 and 75. The connecting rod 77 then does indeed execute a pivoting movement about the journal which connects it to the positioning crank 78, but this movement remains without effect on the adjustment of the lower feeder 10 due to the locked adjusting wheel 37 and the crank 78 thus blocked. Due to the change of the flexed position of the two links 74 and 75, the positioning member 72 executes a pivoting movement about its axle stub 73, so that the journals 71 carrying the yoke 67 are brought closer to the axle of journal 69 and the stroke of the eccentric 64 acting on the upper rocking shaft 63 is reduced accordingly. Step motor 81 receives step pulses until the structural patterns of the two cloth parts 7 and 8 coincide again.

If during the sewing operation the two cloth parts 7 and 8 shift relative to each other in such a way that the lower cloth part 8 leads relative to the upper cloth part 7, then the step motor 81 receives oppositely directed step pulses and imparts to the control disc 83 a movement in opposite direction to its first rotary movement.

The rocking lever 86 then executes a movement in the opposite direction to its first swinging movement, whereby the flexed position of the two links 74 and 75 is changed oppositely and the journals 71 carrying the yoke 67 are moved away from the axle of journal 69. The stroke of the eccentric 64 acting on the upper rocking shaft 63 is thereby increased. This adjustment of the upper feeder 9 is maintained until the coincidence of the structured patterns of the two cloth parts 7 and 8 is restored.

It is evident from the above disclosure that the difference of the individual cloth parts 7 and 8 resulting during sewing are compensated immediately. The two cloth parts 7 and 8 can thus be joined in a pattern-correct manner with certainty, and shifts of position occurring during the sewing operation can be eliminated immediately. It is, of course, possible to design the control circuit of the step motor 81 so that its drive shaft 82 is brought back into a certain position (to its neutral starting position) after execution of each sewing operation, for example after the stopping of the upper main shaft 55 of the machine.

Instead of the described sequential data determination of a predetermined length zone of the two cloth parts 7 and 8, simultaneous determination of the measured values of the length zone is possible. To this end, instead of one row of light-receiving elements 94', a plurality of parallel rows of these light elements 94' are provided in the sensors 91 and 100.

The light-receiving elements 94 in each row are then joined together and connected to a measuring point. Thus, for each row of light-receiving elements 94' a measuring point is provided, the values of which can then be read into the memories 124 and 125 or 124' and 125' sequentially or in parallel by the signal processing unit 97 during a non-transport phase of the sewing machine.

Another possibility is to design the light-receiving elements 94' of the measuring heads directly as photosensitive elements. They may then consist of a matrix formed by photo diodes, provided they have a sufficiently large number of single elements sufficiently close together to obtain good resolution, the rows which extend crosswise to the feed direction being connected together.

For sewing fabric patterns extending obliquely to the feed direction, the sensor 91 of stitch plate 89 and the sensor 100 may be attached on its support 98 rotatable by certain degrees of angle, in order that their measuring heads 90,102 can adapt themselves to the structure of the cloth parts 7 and 8 then extending obliquely during feed. By this measure the row of light-receiving elements 94' can be adapted to the pattern, so that the intensifying effect caused by the linear merging of the light-receiving elements 94' is maintained in the pattern changes extending in the direction of the row.

Lastly, the field of vision of the sensors 91 and 100 may have rows of light elements 94' extending in the form of rays. For an obliquely extending fabric structure the light elements 94' of a row extending parallel to the structure are then connectable to the respective transducer 95 or 104.

While a specific embodiment of the invention has been shown and described in detail to illustrate the application of the principles of the invention, it will be understood that the invention may be embodied otherwise without departing from such principles.

What is claimed is:

1. A method for the pattern-correct sewing together of two cloth pieces each having structure that defines the same pattern, by a sewing machine with one cloth feed means arranged over and one cloth feed means arranged under the cloth pieces, a relative feed amount of the feed means being variable by at least one positioning system, and with a sensor for sensing the structure of the pattern arranged upstream of a stitch-forming point for each cloth piece in a cloth feed direction and with a signal processing unit which processes signals from the sensors corresponding to a relative position of the patterns on the cloth pieces and which influences the positioning system for the feed means in accordance with the established relative position of the structure of the patterns of the cloth pieces, characterized in that the pattern structure of each cloth piece (7,8) is continuously determined by the sensors (91,100) by measuring values of the structure of the pattern at a measured region for each cloth piece, that the values determined are supplied as signals to the signal processing unit (97), that the signals, taken from the two cloth pieces (7,8) within the same predetermined length of said measured regions upstream of the stitch-forming joint, of both sensors (91,100) are stored independently of each other in the signal processing unit (97) as signal sequences, and that the signal processing unit (97) determines a momentary difference of position between the structures of the patterns of the two cloth pieces (7,8) from the signal sequences by calculation of their degree of overlap and controls the positioning system (80) as a function of the found offset.

2. A method according to claim 1, wherein the signal processing unit (97) comprises an arithmetic unit (112,113,114) which determines the difference of position of the two cloth pieces from the signal sequences measured from the two cloth pieces in the measured regions, and including calculation of a cross correlation function for the cloth pieces and their displacement from an aligned position thereof.

3. A method according to claim 1, characterized in that the cloth pieces are illuminated at measured regions, and that a reflection of the light in each measured region is measured to form the sensor signals and then the signals are transmitted to the signal processing unit (97).

4. A method according to claim 1 characterized in that an evaluation of the measured signal sequences occurs by combination of the measured values of a short length containing a fine part of the structure of the pattern of the cloth pieces and the measured values of a great length comprising a repeat of the structure of the pattern of the cloth pieces.

5. A sewing machine for the pattern-correct sewing together of two cloth pieces each having structure that defines the same pattern, comprising stitch forming means for forming stitches at a stitch forming area;

first cloth feed means for feeding one of the cloth pieces in a feed path;

second cloth feed means for feeding the other cloth piece in the feed path;

relative feed adjustment means connected to at least one of said first and second cloth feed means for changing a relative position between the cloth pieces in the feed path;

first sensor means adjacent the stitch forming area for sensing the structure of the pattern of one cloth piece and for generating a first sequence of signals indicative of positions of the structure of the pattern of the first cloth piece on the feed path;

second sensor means adjacent the stitch forming area for sensing the structure of the pattern of the other cloth piece and for generating a second sequence of signals indicative of positions of the structure of the pattern of the other cloth piece on the feed path;

a signal processing unit connected to said first and second sensor means and connected to said relative feed adjustment means for receiving said first and second sequence of signals and for independently storing said first and second sequence of signals, said signal processing unit having means for determining a momentary positional difference of position between the structure of the patterns of the two cloth pieces for generating a correction signal for application to said relative feed adjustment means for adjusting a relative position between the cloth pieces to align the structure of the patterns thereof.

6. A sewing machine according to claim 5, wherein each of said first and second sensor means includes a light sensor for sensing light reflected from one of the cloth piece patterns, said light sensor comprising a matrix of light receiving elements including rows of elements lying transversely to the feed path.

7. A sewing machine according to claim 5, wherein each sensor means comprises a light sensor including a plurality of light sensing elements extending in rows forming rays, each element of a row being connected to each other element of that row.

8. A sewing machine according to claim 5, wherein each of said first and second sensor means includes a light source for illuminating one of the cloth piece patterns, a light sensor for sensing light reflected from each cloth piece pattern, said signal processing unit comprising an amplifier connected to each light sensor, a multiplexer connected to each amplifier, an analog to digital converter connected to said multiplexer for alternately receiving signals of said first and second sequence of signals, said sewing machine including timing means for generating pulses synchronized with a sewing operation, said timing means connected to said multiplexer for timing the application of signals to said analog to digital converter, storage means connected to said analog to digital converter for storing said first and second sequence of signals, a correlater connected to said storage means for correlating said first and second sequence of signals to generate the signals corresponding to positional offset between the two cloth pieces, and means for applying signals from said correlator to said relative feed adjustment means.

9. A sewing machine according to claim 5, wherein said signal processing means includes an arithmetic unit for determining the momentary difference of position between the cloth pieces and calculating means for calculating a cross correlation function between positions of the structure of the patterns of the cloth pieces as a function of stored information corresponding to the first and second sequence of signals.

10. A sewing machine according to claim 9, wherein each of said sensor means comprises a light source for illuminating one of the cloth pieces, a light sensor for sensing light reflected from the cloth pieces and generating signals corresponding to light and dark areas of the pattern.

11. A sewing machine according to claim 7, wherein each light sensor includes a plurality of light receiving elements lying in a row transversely to the feed path.

12. A sewing machine according to claim 8, wherein each light source comprises a plurality of light source elements lying in a row parallel to and adjacent said row of light receiving elements.

13. A sewing machine according to claim 7, including at least one light guide connected between said light source and one of the cloth pieces adjacent the feed path.

14. A sewing machine according to claim 7, including at least one light guide extending between one of the light sensors and a position adjacent the feed path.

15. A method for the sewing together of two cloth pieces each having structures thereon defining the same pattern and utilizing a sewing machine having one cloth feed means arranged over and one cloth feed means arranged under the cloth pieces, the relative feeding amount of the cloth feed means being variable by a positioning system for feeding the two cloth pieces at different feed amounts, and with a sensor facing each of the cloth pieces arranged upstream of a stitch forming point for each cloth piece in a cloth feed direction, each sensor generating a signal corresponding to variations in the structure defining the pattern on each cloth piece, the method comprising:

taking a first sequence of signals from the sensor for the upper cloth piece corresponding to the structure of the pattern in a measuring region along the feed direction;

taking a second sequence of signals from the sensor for the lower cloth piece corresponding to the structure of the pattern of the lower cloth piece in the same measuring region;

sending the first and the second sequence of signals to a signal processing system which has a storage module with separate memories for the sequences of signals;

storing the first and second sequence of signals in separate memories of the storage module;

determining a degree of coincidence between the first and second sequence of signals in a correlator module of the signal processing system;

calculating the instantaneous difference in position between the structures of the pattern of the upper and lower cloth pieces in an evaluation module and utilizing the degree of coincidence from the correlator module to determine a difference in position between the upper and lower cloth; and using the instantaneous difference in position to control the positioning system for changing the relative feed amounts between the cloth feed means of the upper and lower cloth pieces to bring the structure of the pattern of the upper piece into positional correlation with the structure of the pattern of the lower cloth piece.

* * * * *